US011395512B2

(12) United States Patent
Simrell et al.

(10) Patent No.: US 11,395,512 B2
(45) Date of Patent: Jul. 26, 2022

(54) VAPORIZER COOLING SYSTEM WITH A MIXING CHAMBER

(71) Applicant: Simrell Collection, LLC, Toledo, OH (US)

(72) Inventors: Austyn Simrell, Toledo, OH (US); Anthony Ciacelli, Toledo, OH (US); Norman Russell Wymer, Jr., Perrysburg, OH (US)

(73) Assignee: SIMRELL COLLECTION, LLC, Toledo, OH (US)

( * ) Notice: Subject to any disclaimer, the term of this patent is extended or adjusted under 35 U.S.C. 154(b) by 282 days.

(21) Appl. No.: 16/872,540

(22) Filed: May 12, 2020

(65) Prior Publication Data

US 2020/0359686 A1 Nov. 19, 2020

Related U.S. Application Data

(60) Provisional application No. 62/847,053, filed on May 13, 2019, provisional application No. 62/873,999, filed on Jul. 15, 2019.

(51) Int. Cl.
*A24F 40/40* (2020.01)

(52) U.S. Cl.
CPC ..... *A24F 40/40* (2020.01)

(58) Field of Classification Search
CPC ..... A24F 40/40; A24F 40/48; A24F 40/10; A24F 40/30; A24F 40/00; A24F 40/57
USPC ..... 131/329
See application file for complete search history.

(56) References Cited

U.S. PATENT DOCUMENTS

| | | | | |
|---|---|---|---|---|
| D751,487 | S * | 3/2016 | Harriton | D12/211 |
| 10,206,425 | B2 * | 2/2019 | Breiwa, III | A61M 15/06 |
| 2013/0014755 | A1 * | 1/2013 | Kumar | A24F 42/10 128/202.21 |
| 2015/0040926 | A1 | 2/2015 | Saydar et al. | |
| 2015/0150305 | A1 * | 6/2015 | Shenkal | A24F 40/485 131/329 |
| 2015/0163859 | A1 * | 6/2015 | Schneider | A24F 40/46 219/535 |

(Continued)

FOREIGN PATENT DOCUMENTS

| | | | |
|---|---|---|---|
| WO | 2014020953 | A1 | 2/2017 |
| WO | 2017032695 | A1 | 3/2017 |

*Primary Examiner* — Harshad C Patel
(74) *Attorney, Agent, or Firm* — Michael E. Dockins; Shumaker, Loop & Kendrick, LLP

(57) ABSTRACT

Vaporizer cooling systems are provided including an outer tubular member, an inner tubular member, and optionally an insert. The outer tubular member includes a first open end, a second open end, and a port positioned intermediate the first open end and the second open end, where the port provides fluid communication between an exterior and an interior of the outer tubular member. The inner tubular member includes a first open end and a second open end, where the inner tubular member is received within the outer tubular member so that the port provides fluid communication with the first open end of the outer tubular member without passing through the inner tubular member. The insert can be disposed within the inner tubular member and can have a helical portion. Such vaporizer cooling systems can be used to temper an amount of heated vapor passing therethrough.

20 Claims, 12 Drawing Sheets

(56) References Cited

U.S. PATENT DOCUMENTS

| | | | | |
|---|---|---|---|---|
| 2015/0296888 | A1* | 10/2015 | Liu | A24F 40/60 131/329 |
| 2015/0374036 | A1* | 12/2015 | Suzuki | A24B 15/165 131/329 |
| 2015/0374039 | A1* | 12/2015 | Zhu | H05B 3/03 131/329 |
| 2016/0121058 | A1* | 5/2016 | Chen | A24F 40/40 128/200.19 |
| 2016/0143356 | A1* | 5/2016 | Poget | A24F 42/60 131/329 |
| 2016/0150823 | A1* | 6/2016 | Liu | H05B 3/46 131/328 |
| 2017/0013877 | A1 | 1/2017 | Breiwa, III | |
| 2019/0142073 | A1* | 5/2019 | Nakano | A24F 40/485 131/329 |
| 2019/0230997 | A1* | 8/2019 | Minskoff | A24F 40/42 |

* cited by examiner

SECTION B-B

VAPORIZER COOLING SYSTEM WITH A MIXING CHAMBER

CROSS-REFERENCE TO RELATED APPLICATIONS

This application claims the benefit of U.S. Provisional Application No. 62/847,053, filed on May 13, 2019, and U.S. Provisional Application No. 62/873,999, filed on Jul. 15, 2019. The entire disclosures of the above applications are incorporated herein by reference.

FIELD

The present technology relates to the field of vaporizer cooling systems, and more specifically to a vaporizer cooling system having modular components for use with an external heating source.

INTRODUCTION

This section provides background information related to the present disclosure which is not necessarily prior art.

Various inhalation devices or vaporizers include implements for aerosolizing or vaporizing various substances for introduction into the respiratory system. Inhaled substances can be recreational or therapeutic in nature and can include certain natural, isolated, and/or synthetic substances. Examples of vaporized substances include certain plant materials, such as tobacco, *cannabis*, or other herbs or blends of essential oils. Vaporized substances can be combined with various vehicles, compounds, flavorings, etc., such as propylene glycol, glycerin, nicotine (e.g., extracted from tobacco), and provided in various liquid solutions. Use of a vaporizer is sometimes colloquially known as the act of "vaping" and the vaporizer device itself can be referred to as a "vape."

Vaporizers can be configured with different types of extraction chambers, including those having a straight bore, venturi, or sequential venturi, and can employ various materials, including heat resistant materials, such as metal or glass. Extracted vapor can be collected in various types of chambers or inhaled directly through a conduit. Certain vaporizers can provide extracted vapor at cooler temperatures than obtained by traditional smoking, which can be due at least in part to the absence of combustion as found in a smoking material, such as tobacco, and can result in more efficient extraction of desired compounds from the vaporized material. Hence, certain irritating and undesirable effects attributable to smoking can be reduced or minimized by vaping, including secondhand smoke.

An electronic cigarette, also referred to as an e-cigarette, is one type of a handheld battery-powered vaporizer that can simulate smoking by providing some of the behavioral aspects of smoking, including the hand-to-mouth action of smoking, but without combusting tobacco. Instead of cigarette smoke generated from combustion, the user or vapor inhales an aerosol, commonly called vapor. E-cigarettes can include a heating element that atomizes a liquid solution called e-liquid to form the vapor. Certain e-cigarettes are automatically activated by the user inhaling or drawing breath therethrough, while other e-cigarettes can turn on manually; e.g., by pressing a button. E-cigarettes can take many forms, can have an appearance like traditional cigarettes, can be reusable by replacement of vapor cartridges and batteries, for example, although certain e-cigarettes can be designed to be disposable.

Various types of vaporizers, including e-cigarettes, are increasing in popularity in recent years. As consumers become more aware of health consequences of inhaling smoke produced by combusting tobacco and other substances, vaporizers are seen as a better alternative to cigarettes, cigars, pipes, and other smoking implements. While some vaporizers are large and bulky—sometimes intended to mimic the aesthetic look of a hookah—most vaporizers are small enough to fit into a user's pocket or purse for convenience. However, known vaporizers can have certain drawbacks, including excess heat within the vapor to be inhaled, for example, when the vapor arises from an external heat source such as an electronic heating element. Traditional smoking devices have mitigated heat from inhaled smoke by passing the smoke through conduits of increased length and/or passing the smoke through various heat sinks, including water reservoirs. Such means for reducing the temperature of inhaled smoke or vapor can unfortunately present difficulties in cleaning and sanitizing and can be difficult to customize to a user's preferences with respect to heat abatement.

Accordingly, there is a need for a vaporizer cooling system that can serve to temper the amount of heated vapor passing therethrough, provide adaptability in temperature reduction based upon a user's preferences, and that is easy to disassemble/reassemble for cleaning and changing configurations thereof.

SUMMARY

The present technology includes articles of manufacture, systems, and processes that relate to a vaporizer cooling system, including a vaporizer cooling system having modular components for use with an external heating source.

Vaporizer cooling systems and ways of making and using such vaporizer cooling systems are provided that include an outer tubular member and an inner tubular member. The outer tubular member includes a first open end, a second open end, and a port positioned intermediate the first open end and the second open end. The port provides fluid communication between an exterior and an interior of the outer tubular member. The inner tubular member includes a first open end and a second open end. The inner tubular member is received within the outer tubular member so that the port provides fluid communication with the first open end of the outer tubular member without passing through the inner tubular member. A mixing chamber can be located between the first end of the outer tubular member and the first end of the inner tubular member. An insert can be disposed within the inner tubular member. The insert can increase a path length between the first end of the inner tubular member and the second end of the inner tubular member. The increased path length can increase a surface area of the vaporizer cooling system to which a vapor drawn therethrough is exposed, thereby increasing heat transfer between the vapor and the vaporizer cooling system. Likewise, the increased path length can increase the time necessary for the vapor to pass through the vaporizer cooling system and thereby increase heat exchange between the vapor and the vaporizer cooling system as well as between the vaporizer cooling system and the ambient environment. In certain embodiments, the insert includes a helical portion. The insert can accordingly induce turbulence in a fluid (e.g., vapor) moving between the first end of the inner tubular member and the second end of the inner tubular member. For example, the insert can disrupt laminar flow of a fluid through the inner tubular member, causing the fluid/vapor to mix as well as causing a reduction in speed at which the fluid/vapor can be drawn through the vaporizer cooling system.

Vaporizer cooling systems provided herein can also be used in various ways, including where a fluid is drawn from the second end of the outer tubular member to the first end of the outer tubular member. The port can be obstructed while the fluid is being drawn from the second end of the outer tubular member to the first end of the outer tubular member. In this way, a user can draw fluid/vapor from a vapor generating source (e.g., an external heating source) through the vaporizer cooling system. It is also possible to remove an obstruction from the port while the fluid is being drawn from the second end of the outer tubular member to the first end of the outer tubular member. In this way, a user can allow fresh air to be drawn through the port and mix with fluid/vapor drawn from the vapor generating source.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

DETAILED DESCRIPTION

Figure 1:
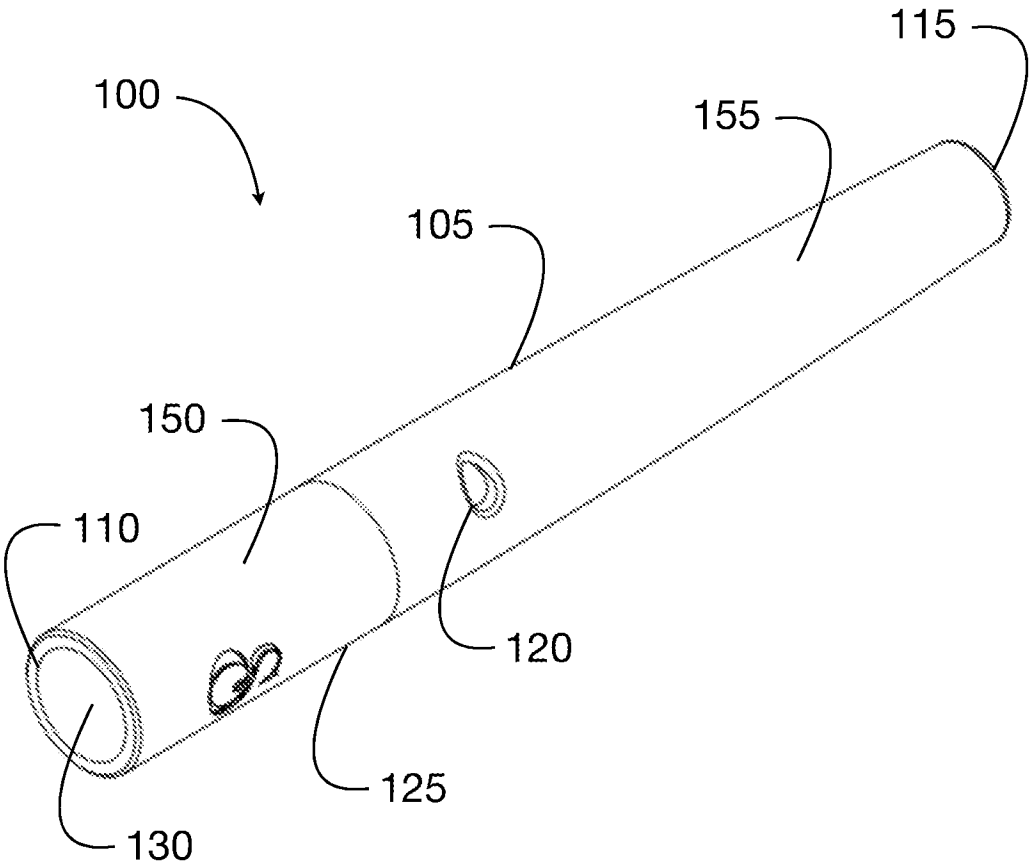
FIG. 1 is a schematic perspective view of a vaporizer cooling system constructed in accordance with the present technology.

The following description of technology is merely exemplary in nature of the subject matter, manufacture and use of one or more inventions, and is not intended to limit the scope, application, or uses of any specific invention claimed in this application or in such other applications as may be filed claiming priority to this application, or patents issuing therefrom. Regarding methods disclosed, the order of the steps presented is exemplary in nature, and thus, the order of the steps can be different in various embodiments, including where certain steps can be simultaneously performed. "A" and "an" as used herein indicate "at least one" of the item is present; a plurality of such items may be present, when possible. Except where otherwise expressly indicated, all numerical quantities in this description are to be understood as modified by the word "about" and all geometric and spatial descriptors are to be understood as modified by the word "substantially" in describing the broadest scope of the technology. "About" when applied to numerical values indicates that the calculation or the measurement allows some slight imprecision in the value (with some approach to exactness in the value; approximately or reasonably close to the value; nearly). If, for some reason, the imprecision provided by "about" and/or "substantially" is not otherwise understood in the art with this ordinary meaning, then "about" and/or "substantially" as used herein indicates at least variations that may arise from ordinary methods of measuring or using such parameters.

All documents, including patents, patent applications, and scientific literature cited in this detailed description are incorporated herein by reference, unless otherwise expressly indicated. Where any conflict or ambiguity may exist between a document incorporated by reference and this detailed description, the present detailed description controls.

Although the open-ended term "comprising," as a synonym of non-restrictive terms such as including, containing, or having, is used herein to describe and claim embodiments of the present technology, embodiments may alternatively be described using more limiting terms such as "consisting of" or "consisting essentially of" Thus, for any given embodiment reciting materials, components, or process steps, the present technology also specifically includes embodiments consisting of, or consisting essentially of, such materials, components, or process steps excluding additional materials, components or processes (for consisting of) and excluding additional materials, components or processes affecting the significant properties of the embodiment (for consisting essentially of), even though such additional materials, components or processes are not explicitly recited in this application. For example, recitation of a composition or process reciting elements A, B and C specifically envisions embodiments consisting of, and consisting essentially of, A, B and C, excluding an element D that may be recited in the art, even though element D is not explicitly described as being excluded herein.

As referred to herein, disclosures of ranges are, unless specified otherwise, inclusive of endpoints and include all distinct values and further divided ranges within the entire range. Thus, for example, a range of "from A to B" or "from about A to about B" is inclusive of A and of B. Disclosure of values and ranges of values for specific parameters (such as amounts, weight percentages, etc.) are not exclusive of other values and ranges of values useful herein. It is envisioned that two or more specific exemplified values for a given parameter may define endpoints for a range of values that may be claimed for the parameter. For example, if Parameter X is exemplified herein to have value A and also exemplified to have value Z, it is envisioned that Parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if Parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, 3-9, and so on.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The present technology relates to vaporizer cooling systems and ways of making and using vaporizer cooling systems. Vaporizer cooling systems are provided that include an outer tubular member having a first open end, a second open end, and a port positioned intermediate the first open end and the second open end, where the port provides fluid communication between an exterior and an interior of the outer tubular member. Such vaporizer cooling systems include an inner tubular member having a first open end and a second open end, the inner tubular member received within the outer tubular member so that the port provides fluid communication with the first open end of the outer tubular member without passing through the inner tubular member. In this way, such vaporizer cooling systems can serve to temper the amount of heated vapor passing therethrough, provide adaptability in temperature reduction based upon a user's preferences, and are amenable to disassembly/reassembly for cleaning and changing configurations thereof.

The outer tubular member can include various aspects. The outer tubular member can include a mouthpiece coupled to a body, where the mouthpiece can include the first open end of the outer tubular member and the body can include the second open end of the outer tubular member. The port can be located in the mouthpiece. The inner tubular member can be received within the body of the outer tubular member and the mouthpiece can be decoupled from the body to expose a portion of the inner tubular member. One of the outer tubular member and the inner tubular member can be cylindrical, or both the outer tubular member and the inner tubular member can be cylindrical.

The inner tubular member can include various aspects. The inner tubular member can be coupled to the outer tubular member proximate to the second end of the inner tubular member, including where the inner tubular member is coupled to the outer tubular member by an interference fit. The coupling between the inner tubular member and the outer tubular member can be located between the port and the second end of the outer tubular member. The inner tubular member can be concentrically received within the outer tubular member. A mixing chamber can be located between the first end of the outer tubular member and the first end of the inner tubular member. The mixing chamber can provide fluid communication between the port and the first end of the outer tubular member and between the first end of the inner tubular member and the first end of the outer tubular member.

The port can provide a means to selectively obstruct or remove an obstruction therefrom to control fluid communication with the first open end of the outer tubular member without passing through the inner tubular member. For example, a user of the vaporizer cooling system can place a fingertip over the port or remove a fingertip from obstructing the port. Other means of selectively obstructing the port can be used, including a slidable covering, snap fitting, cap or plug receivable within the port, etc. By obstructing the port, the user can draw a fluid/vapor from the second end of the outer tubular member through to the second end of the inner tubular member through to the first end of the inner tubular member and through to the first end of the outer tubular member. For example, the user can place their mouth on the first end of the outer tubular member and pull the fluid/vapor therethrough with their mouth and/or by inhaling. By leaving the port unobstructed, the user can draw a fluid/vapor from the second end of the outer tubular member through to the second end of the inner tubular member through to the first end of the inner tubular member and through to the first end of the outer tubular member while simultaneously drawing fluid/air through the port to the first end of the outer tubular member. This can allow fluid/vapor and fluid/air to mix within the mixing chamber where the air can effectively cool the vapor-air mixture as well as reduce an amount of fluid/vapor drawn through the vaporizer cooling system.

In certain embodiments, when the port is obstructed while the user is drawing on the first end of the outer tubular member of the vaporizer cooling system, a reduced pressure is created within the vaporizer cooling system. Once the port is unobstructed, fresh air is drawn in through the port by the low presser and can create a vortex around the inner tubular member that results in turbulence and mixing of the fresh air and fluid/vapor being drawn into the vaporizer cooling system from the second end of the outer tubular member. Where the vaporizer cooling system is configured with the mixing chamber, the vortex/turbulent air mixes and adds to a Venturi effect ultimately providing additional cooling to the fluid/vapor drawing through the vaporizer cooling system by the user. This mixing can also occur in a space between a portion of the outer tubular member near the first end thereof and a portion of the inner tubular member near the first end thereof. The vortex can then continue through the outer tubular member and exits the first end thereof. The entry of fresh air through the port can also reduce draw resistance in the vaporizer cooling system device.

In certain embodiments of the vaporizer cooling system, the inner tubular member can be substantially the same length as the outer tubular member and is adhered in place therein. It is understood that the inner tubular member can be held in place relative to the outer tubular member via friction, threading, or via a mechanical device such as a rubber fitting or gasket, for example. An outer portion of the inner tubular member can contact and form an interference or friction fitment with an inner portion of the outer tubular member. The location of the interference or friction fitment can be located proximate to the second end of the inner tubular member and can cooperate with an inner portion of the outer tubular member located at various intermediate positions between the first end and the second end of the outer tubular member. In certain embodiments, the inner tubular member has a length less than a length of the outer tubular member and forms a gap therebetween when received therein. The gap can function as a mixing chamber to allow for agitation, mixing, and/or cooling, as desired.

The vaporizer cooling system can include an insert, where the insert can be configured in various ways. The insert can be disposed within the inner tubular member. The insert can be configured to disrupt laminar flow of a fluid through the inner tubular member and the insert can induce turbulence in a fluid moving between the first end of the inner tubular member and the second end of the inner tubular member. The insert can increase a fluid path length between the first end of the inner tubular member and the second end of the inner tubular member. In certain embodiments, the insert includes a helical portion. Other embodiments of the insert can be configured to provide various types of tortuous fluid path lengths, where such fluid path lengths are greater than a fluid path length of the inner tubular member alone. Examples include various inserts that provide various sinuous, spiral, stair step, and/or zigzag fluid path lengths. Such inserts can provide a nonlinear fluid pathway through the inner tubular member and can increase a surface area in contact with a fluid drawn through the inner tubular member. Disrupted laminar flow, turbulence, increased surface area, and/or increased time spent within the inner tubular member can each alone and in combination result in cooling of a fluid drawn through the combination of the inner tubular member and the insert. Various types of inserts can provide predetermined amounts of cooling, which can allow a user to select an insert or replace an insert to achieve a customized or desired cooling effect. A majority of the insert can be disposed within the inner tubular member and/or a portion of the insert can extend from the first end of the inner tubular member. The portion of the insert that extends from the first end of the inner tubular member can include a tab. The tab can facilitate removal of the insert from the inner tubular member so that the vaporizer cooling system can be used without the insert, so that the insert can be replaced with another type of insert, or for cleaning the vaporizer cooling system.

Vaporizer cooling systems provided herein can be used in various ways. Methods of using such vaporizer cooling systems can include drawing a fluid from the second end of the outer tubular member to the first end of the outer tubular member. The port can be obstructed while the fluid is being drawn from the second end of the outer tubular member to the first end of the outer tubular member and/or an obstruction can be removed from the port while the fluid is being drawn from the second end of the outer tubular member to the first end of the outer tubular member.

Certain embodiments of the present technology provide an outer tubular member, an inner tubular member, and an insert that combine to form a cooling stem that cools fluid/vapor by creating a more tortuous pathway through an extraction chamber than an open design. Where the insert provides a helical patterned fluid path, the insert can accomplish its cooling function without causing too much resistance to where functionality is decreased. Elongating the route in which the vapor must travel, coupled with a greater amount of surface area in which the vapor contacts the insert (e.g., metal such as Ti), ultimately causes a sizable reduction in exiting vapor temperature. The cooling stem may be configured to have a zig-zag shape, twisted, shape, or any shape that increases a surface area of the extraction chamber to create a tortuous path for the vapor to travel. The insert can have a portion (e.g., tab) that has a larger diameter than a diameter of the inner tubular member that forms an extraction chamber. The larger portion that is outside the inner tubular member allows the user to quickly insert and/or remove insert from a remainder of the vaporizer cooling system device.

EXAMPLES

Example embodiments of the present technology are provided with reference to the several figures enclosed herewith.

Figure 2:
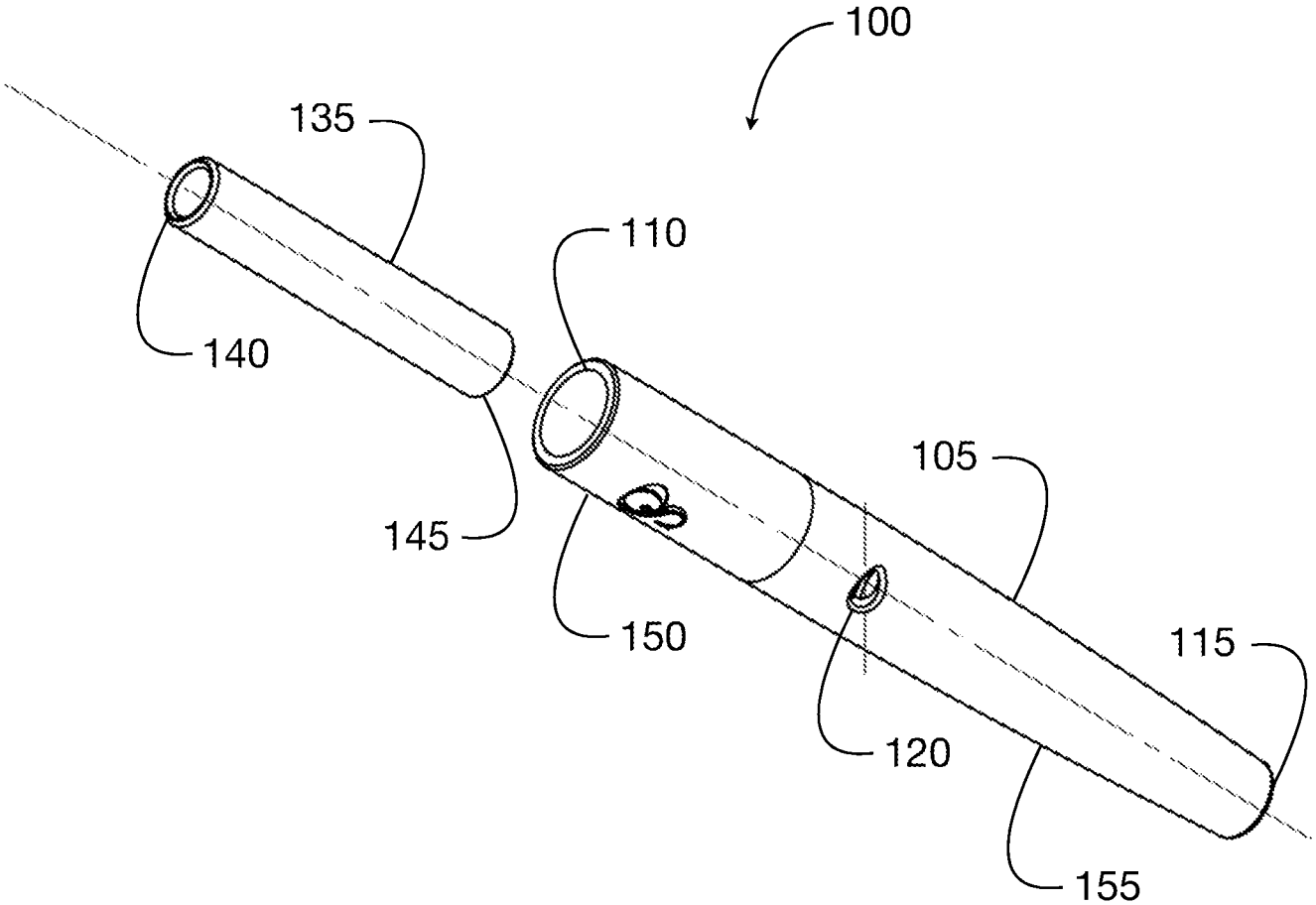
FIG. 2 is a schematic exploded view of the vaporizer cooling system of FIG. 1, showing an outer tubular member and an inner tubular member.
Figure 3:
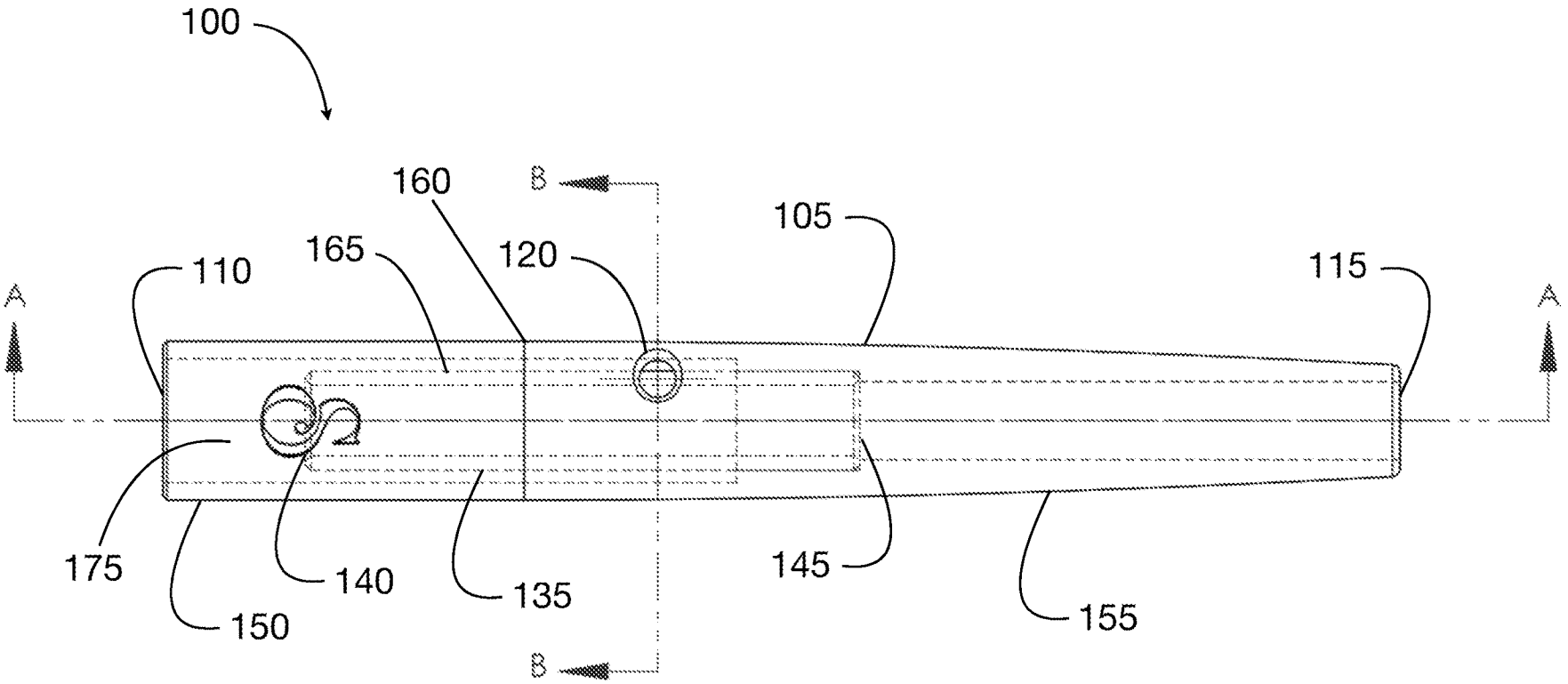
FIG. 3 is a schematic plan view of the vaporizer cooling system of FIG. 1, showing internal components in phantom lines and depicting origins of the cross-sectional views A-A and B-B of FIGS. 4 and 5, respectively.
Figure 4:
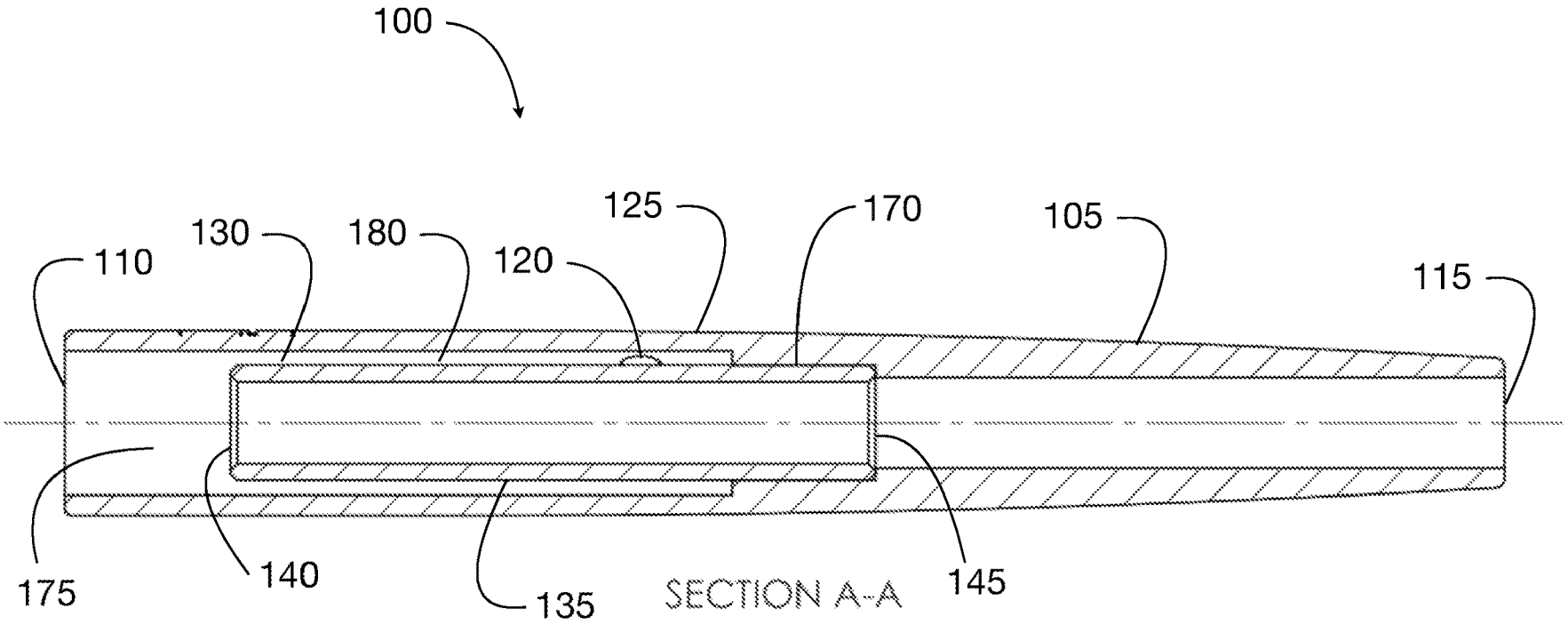
FIG. 4 is a schematic cross-sectional view of the vaporizer cooling system of FIG. 1, showing a cross-section taken along plane A-A in FIG. 3.
Figure 5:
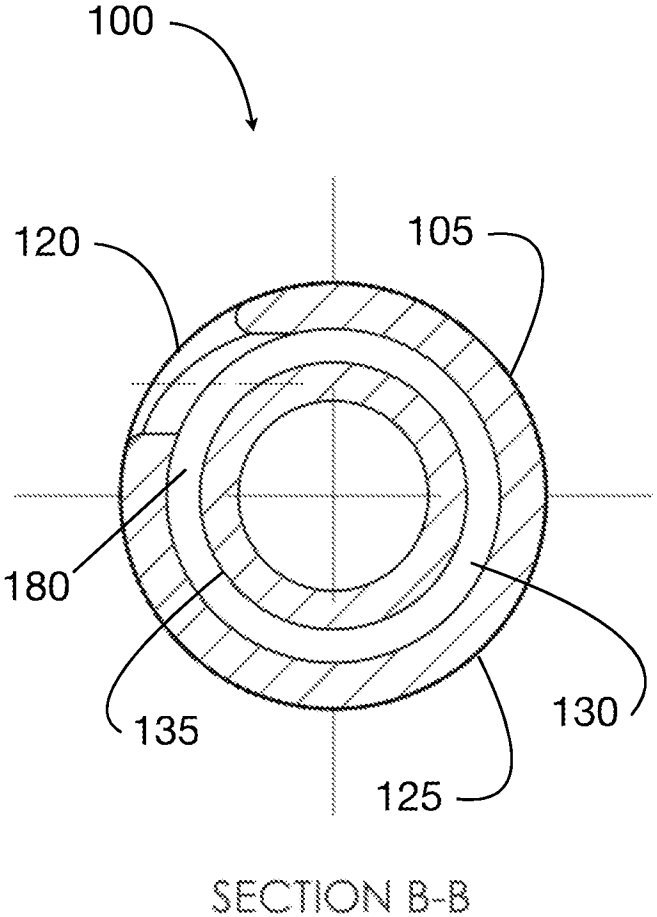
FIG. 5 is a schematic cross-sectional view of the vaporizer cooling system of FIG. 1, showing a cross-section taken along plane B-B in FIG. 3.
Figure 6:
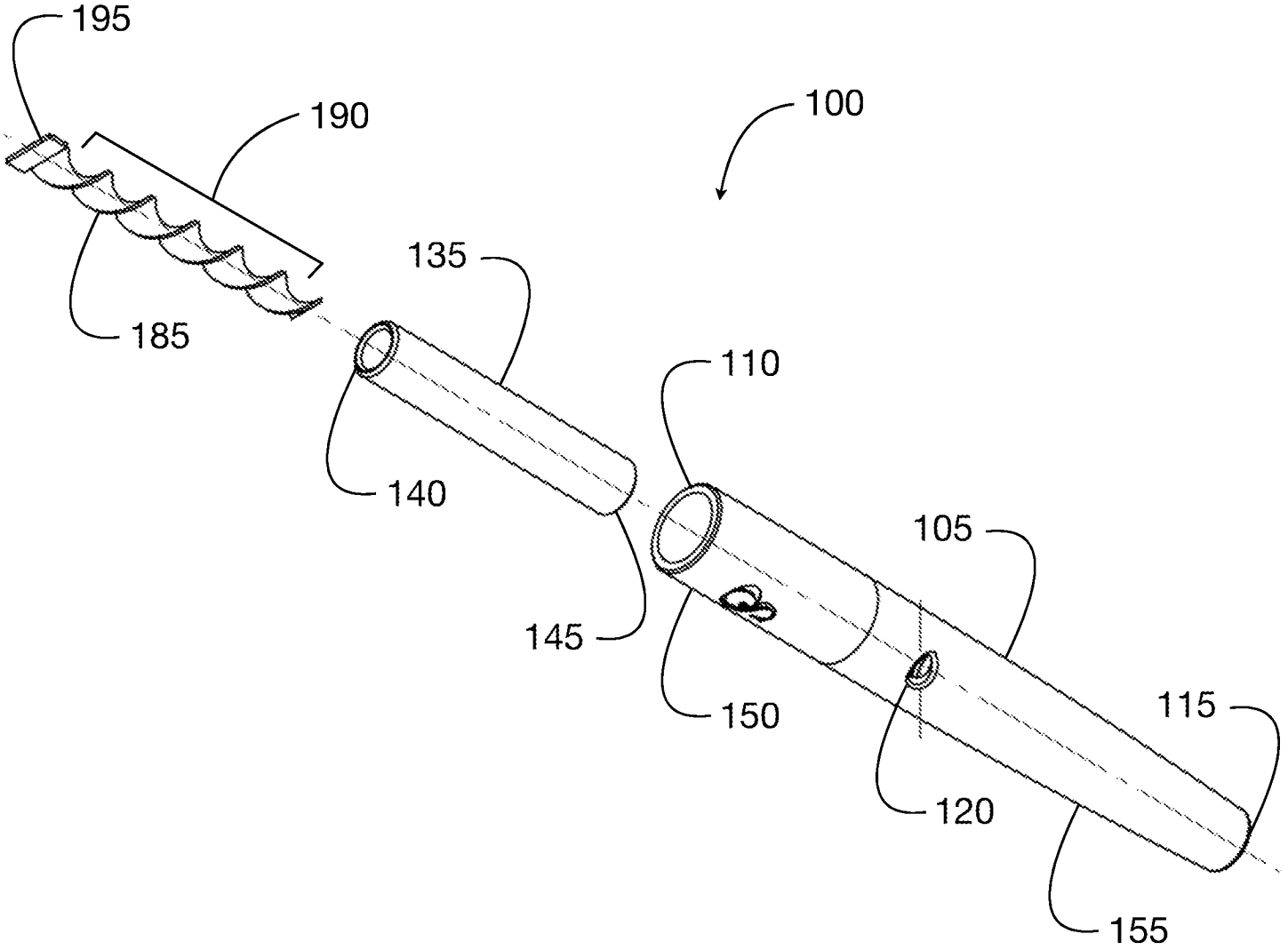
FIG. 6 is a schematic exploded view of the vaporizer cooling system of FIG. 1, further including an insert that can be disposed within the inner tubular member.
Figure 7:
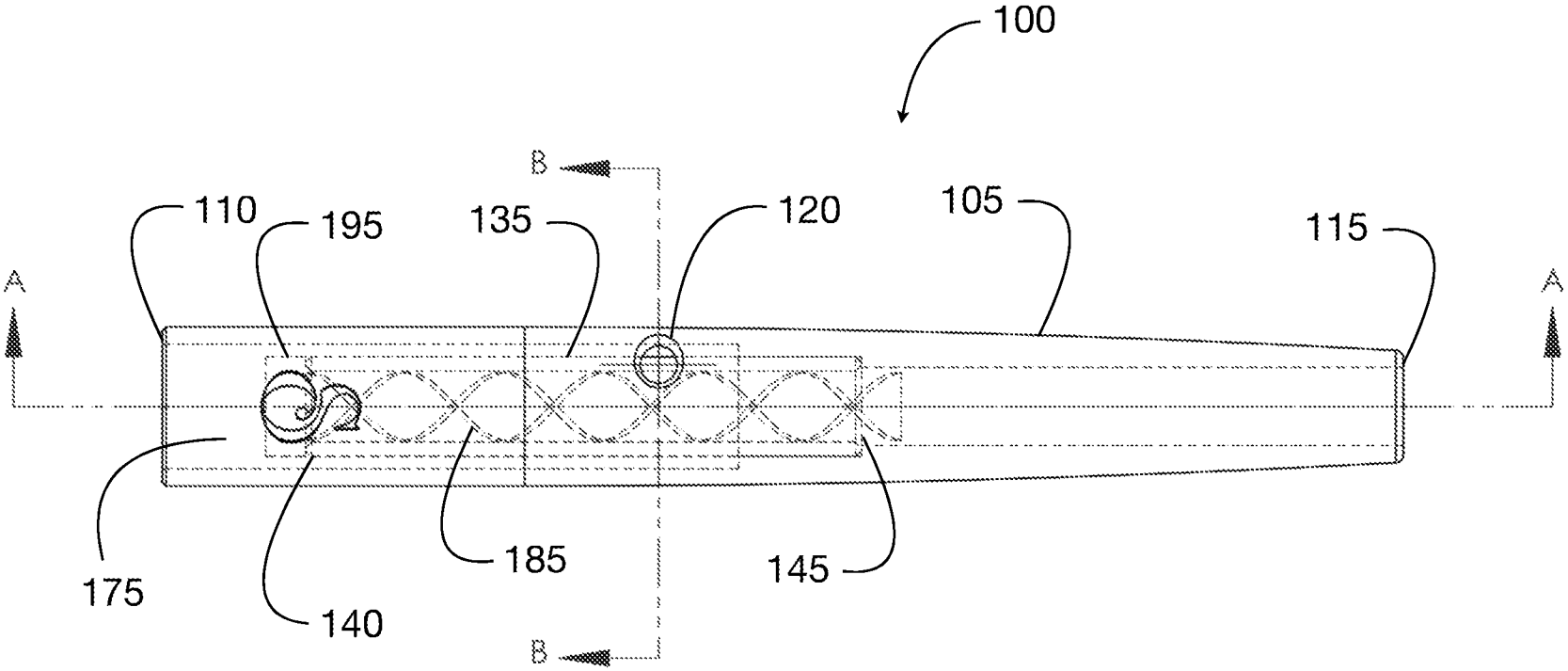
FIG. 7 is a schematic plan view of the vaporizer cooling system of FIG. 6, showing internal components in phantom lines and depicting origins of the cross-sectional views A-A and B-B of FIGS. 8 and 9, respectively.
Figure 8:
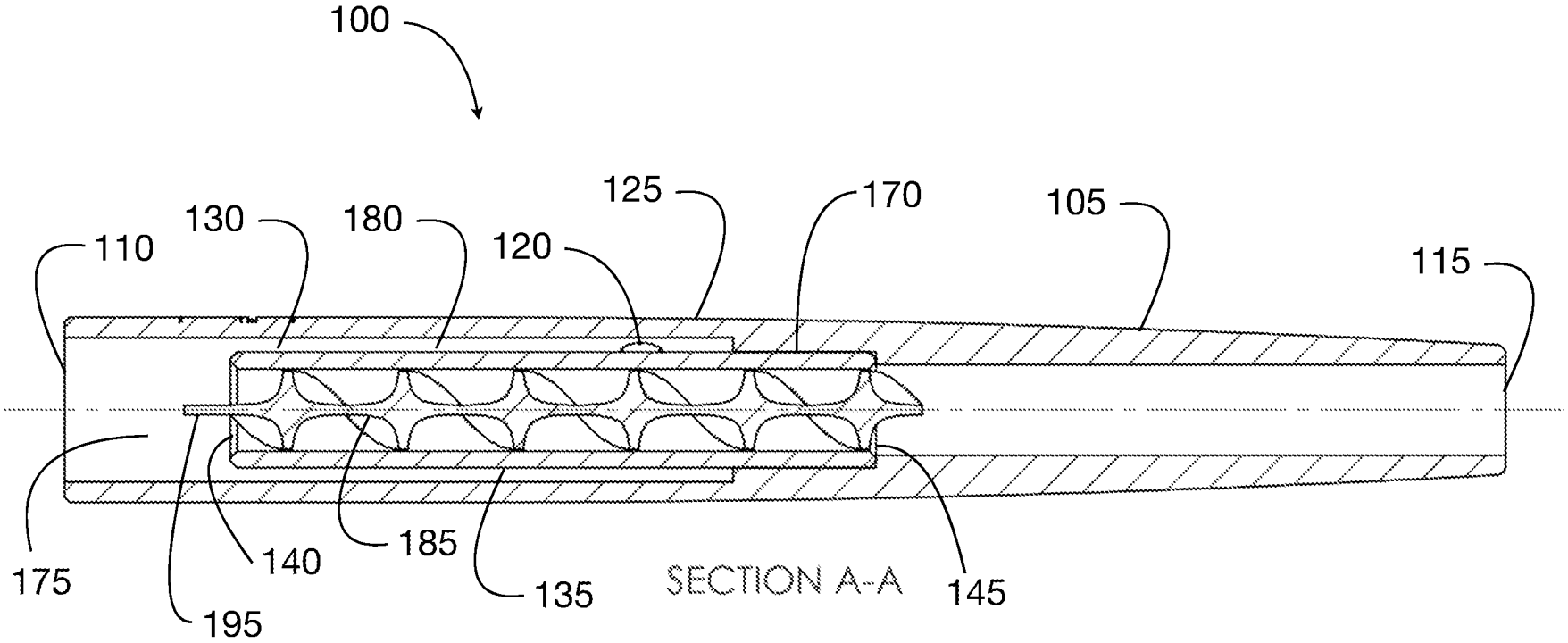
FIG. 8 is a schematic cross-sectional view of the vaporizer cooling system of FIG. 6, showing a cross-section taken along plane A-A in FIG. 7.
Figure 9:
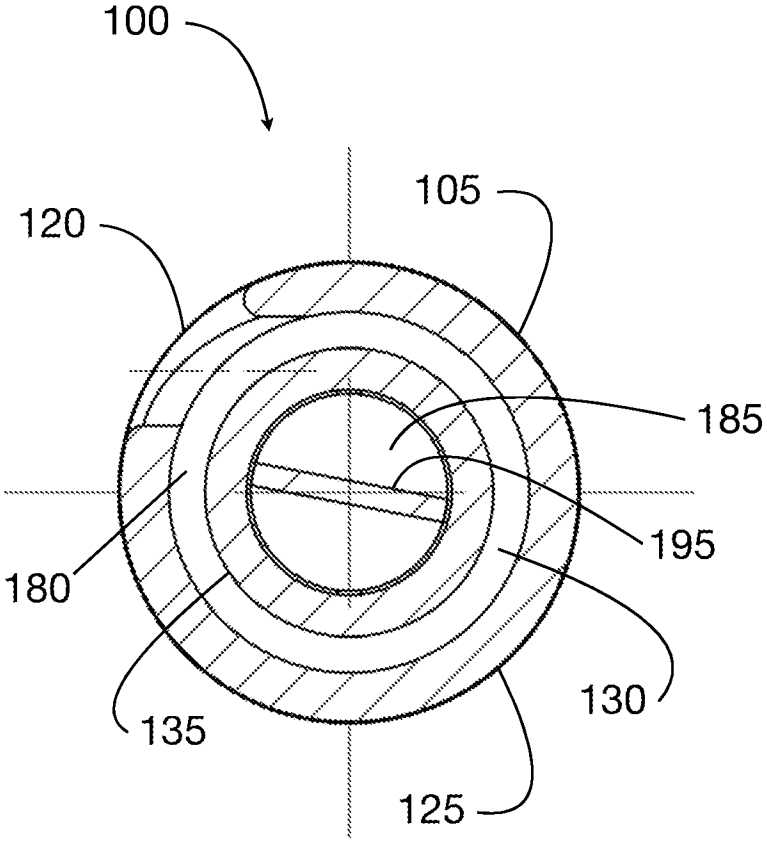
FIG. 9 is a schematic view of the vaporizer cooling system of FIG. 6, showing a cross-section taken along plane B-B in FIG. 7.
Figure 10:
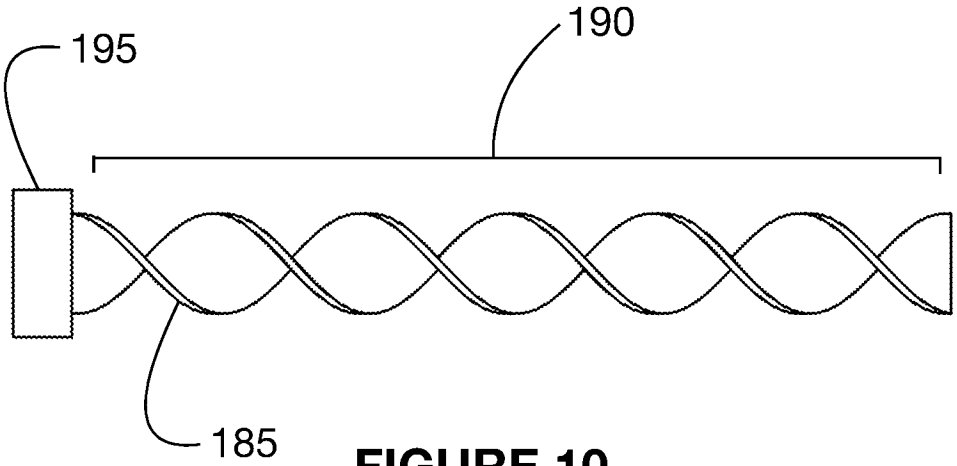
FIG. 10 is a schematic side elevational view of the insert of the vaporizer cooling system of FIG. 6.
Figure 11:
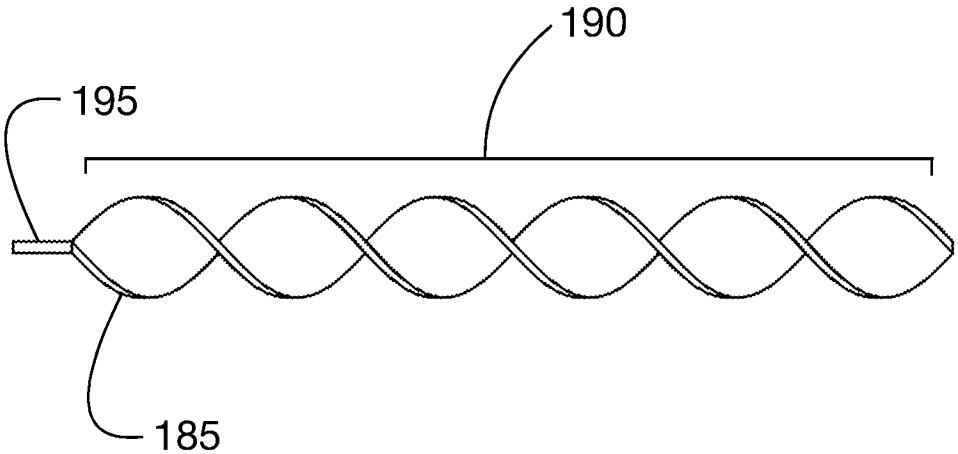
FIG. 11 is a schematic top plan view of the insert of FIG. 6.
Figure 12:
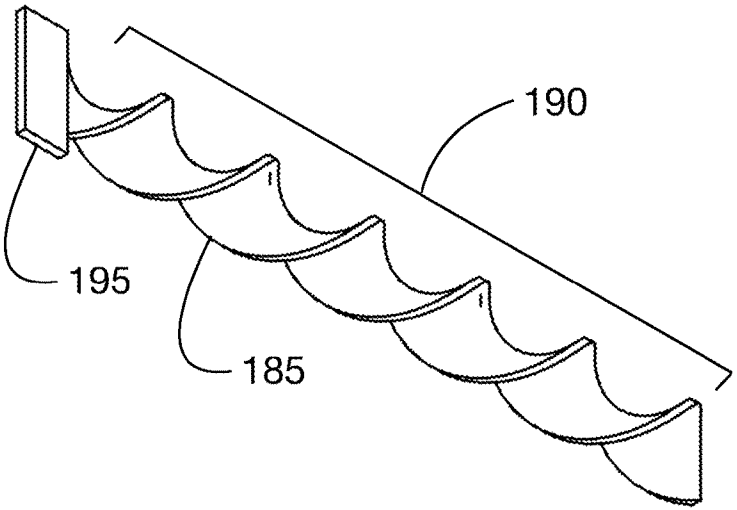
FIG. 12 is a schematic perspective view of the insert of FIG. 6.
Figure 13:
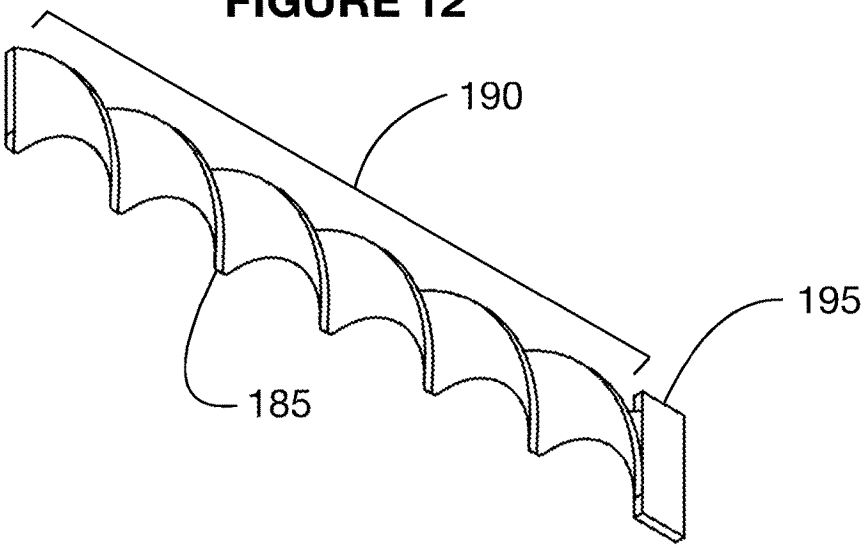
FIG. 13 is a schematic reversed perspective view of the insert of FIG. 6.
Figure 15:
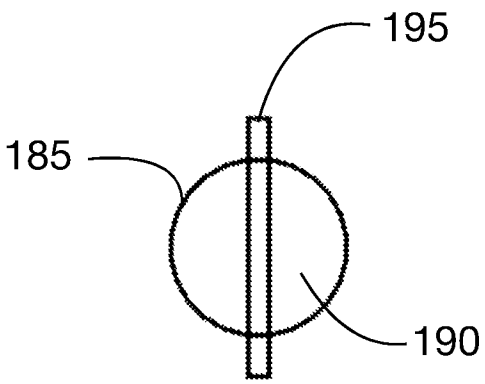
FIG. 15 is a schematic side elevational view of another end of the insert of FIG. 6.
Figure 14:
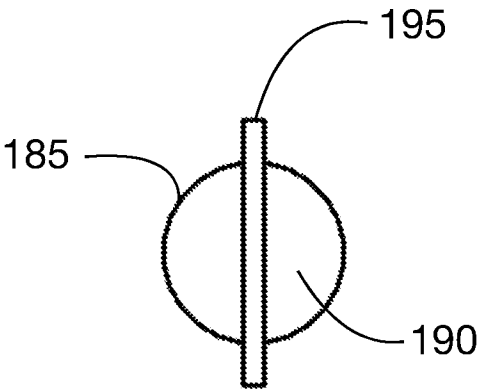
FIG. 14 is a schematic side elevational view of one end of the insert of FIG. 6.

With reference to FIGS. 1-15, an embodiment of a vaporizer cooling system 100 is shown that has an outer tubular member 105 including a first open end 110, a second open end 115, and a port 120 positioned intermediate the first open end 110 and the second open end 115. The port 120 provides fluid communication between an exterior 125 and an interior 130 of the outer tubular member 105. The vaporizer cooling system 100 has an inner tubular member 135 including a first open 140 end and a second open end 145, where the inner tubular member 135 is received within the outer tubular member 105 so that the port 120 provides fluid communication with the first open end 110 of the outer tubular member without passing through the inner tubular member 135.

In the embodiment depicted, the outer tubular member 105 includes a mouthpiece 150 coupled to a body 155 at 160, where the mouthpiece 150 includes the first open end 110 and the body 155 includes the second open end 115. As shown, the port 120 is located in the body 155 portion of the outer tubular member 105. The inner tubular member 135 is received within the body 155 of the outer tubular member 105 and the mouthpiece 150 can be decoupled from the body 155 to expose a portion 165 of the inner tubular member. Both the outer tubular member 105 and the inner tubular member 135 of the vaporizer cooling system 100 can be substantially cylindrical as shown.

The inner tubular member 135 is shown coupled to the outer tubular member 105 proximate to the second end 145 of the inner tubular member 135. In particular, the inner tubular member 135 is coupled to the outer tubular member 105 proximate to the second end 145 of the inner tubular member 135 by an interference fit at 170. The coupling between the inner tubular member 135 and the outer tubular member 105 is located between the port 120 and the second end 115 of the outer tubular member 105. As can be best seen in FIG. 5, the inner tubular member 135 is concentrically received within the outer tubular member 105.

A mixing chamber 175 is located between the first end 110 of the outer tubular member 105 and the first end 140 of the inner tubular member 135. The mixing chamber 175 provides fluid communication between the port 120 and the first end 110 of the outer tubular member 105 and between the first end 140 of the inner tubular member 135 and the first end 110 of the outer tubular member 105. The mixing chamber 175 as well as a gap 180 between the outer tubular member 105 and the inner tubular member 135 can induce turbulence in fluid/vapor drawn through the vaporizer cooling system 100.

In the embodiment of the vaporizer cooling system 100 depicted, an insert 185 is disposed within the inner tubular member 135 so that the insert 185 disrupts laminar flow of a fluid or vapor through the inner tubular member 135. The insert 185 increases a fluid path length between the first end 140 of the inner tubular member 135 and the second end 145 of the inner tubular member 135. The insert 185 shown has a helical portion 190 that can induce turbulence in a fluid moving between the first end 140 of the inner tubular member 135 and the second end 145 of the inner tubular member 135. As shown, a majority of the insert 185 is disposed within the inner tubular member 135. A portion of the insert 185, however, extends from the first end 140 of the inner tubular member 135, which includes a tab 195.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. Equivalent changes, modifications and variations of some embodiments, materials, compositions and methods can be made within the scope of the present technology, with substantially similar results.

What is claimed is:

1. A vaporizer cooling system comprising:

an outer tubular member including a first open end, a second open end, and a port positioned intermediate the first open end and the second open end, the port providing fluid communication between an exterior and an interior of the outer tubular member;

an inner tubular member including a first open end and a second open end, the inner tubular member received within the outer tubular member so that the port provides fluid communication with the first open end of the outer tubular member without passing through the inner tubular member.

2. The vaporizer cooling system of claim 1, wherein the outer tubular member includes a mouthpiece coupled to a body, the mouthpiece including the first open end and the body including the second open end.

3. The vaporizer cooling system of claim 2, wherein the port is located in the body.

4. The vaporizer cooling system of claim 2, wherein the inner tubular member is received within the body of the outer tubular member and the mouthpiece can be decoupled from the body to expose a portion of the inner tubular member.

5. The vaporizer cooling system of claim 1, wherein the outer tubular member is cylindrical, the inner tubular member is cylindrical, or the outer tubular member and the inner tubular member are each cylindrical.

6. The vaporizer cooling system of claim 1, wherein the inner tubular member is coupled to the outer tubular member proximate to the second end of the inner tubular member.

7. The vaporizer cooling system of claim 6, wherein the inner tubular member is coupled to the outer tubular member proximate to the second end of the inner tubular member by an interference fit.

8. The vaporizer cooling system of claim 6, wherein the coupling between the inner tubular member and the outer tubular member is located between the port and the second end of the outer tubular member.

9. The vaporizer cooling system of claim 1, wherein the inner tubular member is concentrically received within the outer tubular member.

10. The vaporizer cooling system of claim 1, further comprising a mixing chamber located between the first end of the outer tubular member and the first end of the inner tubular member.

11. The vaporizer cooling system of claim 10, wherein the mixing chamber provides fluid communication between the port and the first end of the outer tubular member and between the first end of the inner tubular member and the first end of the outer tubular member.

12. The vaporizer cooling system of claim 1, further comprising an insert disposed within the inner tubular member.

13. The vaporizer cooling system of claim 12, wherein the insert disrupts laminar flow of a fluid through the inner tubular member.

14. The vaporizer cooling system of claim 12, wherein the insert increases a path length between the first end of the inner tubular member and the second end of the inner tubular member.

15. The vaporizer cooling system of claim 12, wherein the insert includes a helical portion.

16. The vaporizer cooling system of claim 12, wherein the insert induces turbulence in a fluid moving between the first end of the inner tubular member and the second end of the inner tubular member.

17. The vaporizer cooling system of claim 12, wherein a majority of the insert is disposed within the inner tubular member.

18. The vaporizer cooling system of claim 1, wherein a portion of the insert extends from the first end of the inner tubular member.

19. The vaporizer cooling system of claim 18, wherein the portion of the insert that extends from the first end of the inner tubular member includes a tab.

20. A method of using a vaporizer cooling system according to claim 1, the method comprising:

drawing a fluid from the second end of the outer tubular member to the first end of the outer tubular member; and performing one of:

obstructing the port while the fluid is being drawn from the second end of the outer tubular member to the first end of the outer tubular member; and removing an obstruction from the port while the fluid is being drawn from the second end of the outer tubular member to the first end of the outer tubular member.

* * * * *